US010843771B2

(12) United States Patent
Thomas

(10) Patent No.: US 10,843,771 B2
(45) Date of Patent: Nov. 24, 2020

(54) EXPANSION DECK SYSTEM FOR VESSELS

(71) Applicant: Michael Thomas, Deland, FL (US)

(72) Inventor: Michael Thomas, Deland, FL (US)

( * ) Notice: Subject to any disclaimer, the term of this patent is extended or adjusted under 35 U.S.C. 154(b) by 0 days.

(21) Appl. No.: 16/352,439

(22) Filed: Mar. 13, 2019

(65) Prior Publication Data

US 2019/0283840 A1 Sep. 19, 2019

Related U.S. Application Data

(60) Provisional application No. 62/642,258, filed on Mar. 13, 2018.

(51) Int. Cl.

| | |
|---|---|
| ***B63B 7/02*** | (2020.01) |
| ***B63B 1/10*** | (2006.01) |
| ***B63B 17/04*** | (2006.01) |
| *B63B 7/00* | (2020.01) |

(52) U.S. Cl.

CPC ..... *B63B 7/02* (2013.01); *B63B 1/10* (2013.01); *B63B 17/04* (2013.01); *B63B 2007/003* (2013.01)

(58) Field of Classification Search

CPC .. B63B 29/00; B63B 7/00; B63B 7/02; B63B 3/00; B63B 3/48; B63B 17/00; B63B 17/04; B63B 1/00; B63B 1/10; B63B 3/08

USPC ..... 114/353, 354, 362, 364

See application file for complete search history.

(56) References Cited

U.S. PATENT DOCUMENTS

| | | | | |
|---|---|---|---|---|
| 4,085,473 A * | 4/1978 | Franklin | B63B 17/04 | 114/364 |
| 5,915,328 A * | 6/1999 | Rowan | B63B 27/146 | 114/362 |
| 7,004,101 B1 * | 2/2006 | Mardikian | B63B 27/143 | 114/362 |
| 8,752,499 B2 * | 6/2014 | De Basto | B63B 7/04 | 114/364 |
| 2015/0096486 A1 * | 4/2015 | Admire | B63B 7/04 | 114/364 |

* cited by examiner

*Primary Examiner* — Lars A Olson

(74) *Attorney, Agent, or Firm* — Jason T. Daniel, Esq.; Daniel Law Offices, P.A.

(57) ABSTRACT

An expansion deck system for vessels includes an elongated deck body that is pivotally secured to a vessel by a plurality of hinges. The deck body transitions between a folded position that does not affect the overall width of the vessel, and an expanded position that extends outward from the side of the vessel. A plurality of triangular-shaped braces is removably secured to the bottom surface of the deck body. The braces including a first section that extends along an entire width of the deck body and a second section that engages a pontoon of the vessel. An electromechanical bracing unit is positioned along the bottom surface of the vessel and includes a linear actuator that moves an elongated rod between an extended and retracted position, and A power lifting unit transitions the deck body between the folded and extended positions.

11 Claims, 7 Drawing Sheets

EXPANSION DECK SYSTEM FOR VESSELS

CROSS-REFERENCE TO RELATED APPLICATIONS

This application claims the benefit of U.S. Application Ser. No. 62/642,258, filed on Mar. 13, 2018, the contents of which are incorporated herein by reference.

TECHNICAL FIELD

The present invention relates generally to boating, and more particularly to an expansion deck system for a vessel.

BACKGROUND

The statements in this section merely provide background information related to the present disclosure and may not constitute prior art.

Conventional pontoon boats typically constructed from two or more elongated pontoons having a generally flat deck supported along the top ends thereof. In this configuration, most of the seating is arranged along the outer periphery of the deck behind a safety railing, so as to maximize available space along the interior of the vessel.

Although this configuration works well for simply riding in the vessel, it does not lend itself for activities such as fishing or diving, for example, wherein a user needs to be able to walk along the outermost periphery of the vessel. Moreover, because the width of a boat is limited to approximately 8 foot in order to comply with Department of Transportation (DOT) regulations for highway towing, users have been left with few options for using such vessels for expanded activities. Although one prior attempt to provide an auxiliary deck is described in U.S. Pat. No. 9,067,646, to Admire, the proposed system's use of diagonally oriented bracing and limited support structure represent a significant tripping hazard for users and an unstable platform in the water.

Accordingly, it would be beneficial to provide an expansion deck system for a vessel such as a pontoon boat, for example, that can provide a user with an unobstructed expanded deck beyond the above noted seating and railing, that can be used for any number of different activities while remaining within the DOT regulations and not suffering from the above noted drawbacks.

SUMMARY OF THE INVENTION

The present invention is directed to an expansion deck system for vessels. One embodiment of the present invention can include an elongated deck body that can be pivotally secured to a vessel by a plurality of hinges. The deck body can transition between a folded position that does not affect the overall width of the vessel, and an expanded position that extends outward from the side of the vessel.

In one embodiment, the bottom surface of the deck body can include framing and a plurality of brace receivers. Each of the brace receivers can engage a triangular-shaped brace that is removably secured to the bottom surface of the deck body. The brace can include a first section that extends along an entire width of the deck body and a second section that engages a pontoon of the vessel.

In one embodiment, an electromechanical bracing unit is positioned along the bottom surface of the vessel. The bracing unit includes a linear actuator that moves an elongated rod between an extended and retracted position. In the retracted position the distal end of the rod does not extend beyond the side of the vessel. In the extended position the top surface of the rod is in contact with the bottom surface of the deck body and the distal end of the rod extends beneath the outer edge of the deck body.

In one embodiment, the system can include a power lifting unit that can transition the deck body between the folded and extended positions.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
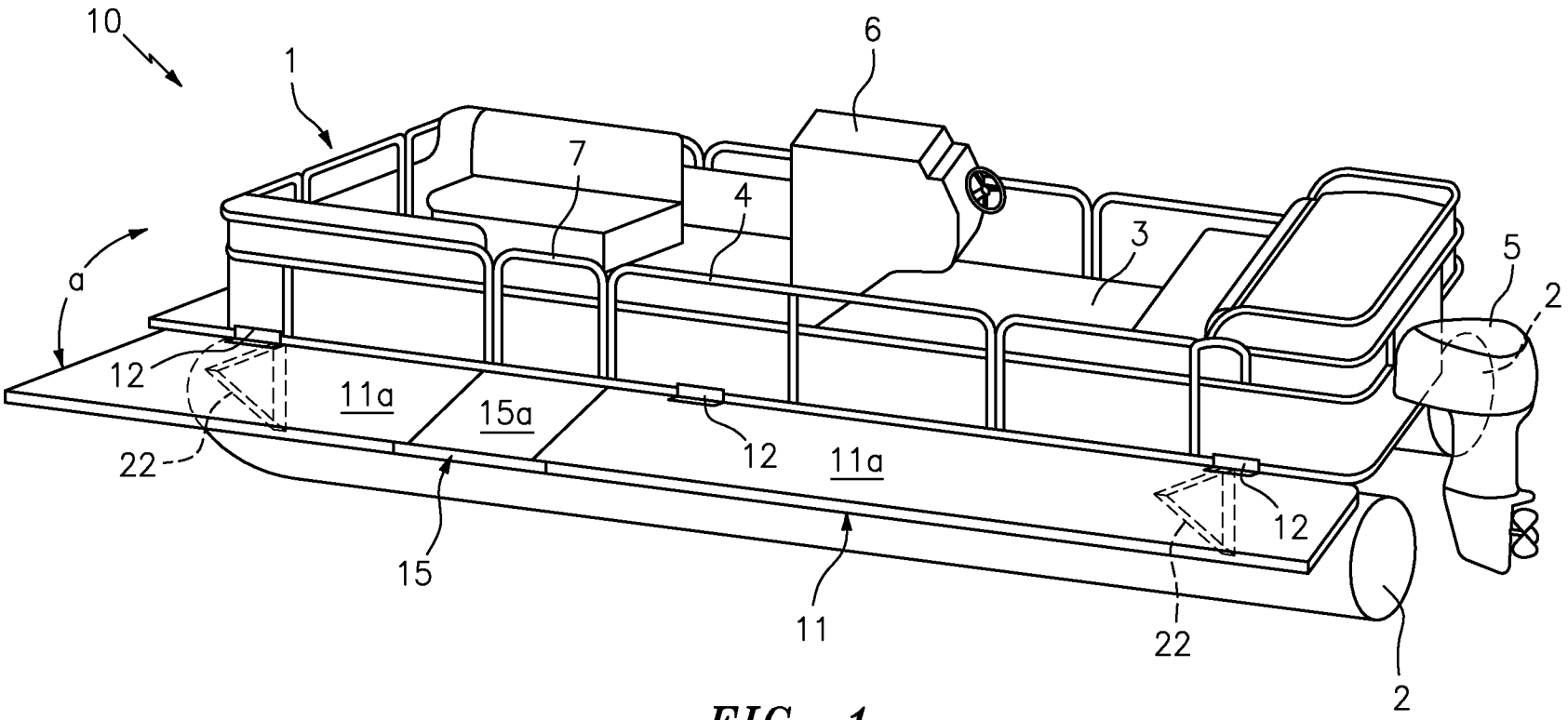
FIG. 1 is a perspective view of an expansion deck system for vessels that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Although the vessel described below is a pontoon boat, this is for illustrative purposes only, as the term "vessel" can apply to any type of watercraft.

As described throughout this document, the term "complementary shape," and "complementary dimension," shall be used to describe a shape and size of a component that is identical to, or substantially identical to the shape and size of another identified component within a tolerance such as, for example, manufacturing tolerances, measurement tolerances or the like.

As described herein, the term "removably secured" and derivatives thereof shall be used to describe a situation wherein two or more objects are joined together in a non-permanent manner so as to allow the same objects to be repeatedly joined and separated. This can be accomplished through the use of any number of commercially available connectors such as opposing strips of hook and loop material, magnets, and/or compression fittings such as locking pins, clamps, nut/bolts, tethers (e.g., zip ties), snaps and buttons, for example.

As described herein, the term "permanently secured" shall be used to describe a situation wherein two or more objects are joined together in a manner so as to prevent the same objects from being separated. Several nonlimiting examples include various adhesives (e.g., glue or resin) permanent mounting hardware (e.g., rivets), and welds, for example.

As described herein, the term "pivotally connected", "rotatably secured" and derivatives thereof shall be used interchangeably to describe a situation wherein two identified objects are joined together in a manner that allows one or both of the objects to pivot, and/or rotate about or in relation to the other object in either a horizontal or vertical manner. Several nonlimiting examples of connectors for pivotally connecting objects together include traditional single hinge mechanisms, ball joint couplers, and/or swivel flanges, for example.

FIGS. 1-4C illustrate one embodiment of an expansion deck system for vessels 10 that are useful for understanding the inventive concepts disclosed herein. In each of the drawings, identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As shown and noted above, a pontoon boat 1 commonly includes a plurality of pontoon floats 2 having a floor 3, a railing 4, a motor 5 and a control console 6. In most instances, the railing can include a door section 7 to allow for ingress and egress of passengers.

In accordance with one embodiment of the invention, one or more expansion decks 10 can be secured along the outer periphery of a pontoon boat 1. Although illustrated along the port side of the boat 1, those of skill in the art will recognize that additional expansion decks can be provided along both sides of the boat as well as the front and rear of the boat, as may be desirable to a user. Each of these decks can be connected along the ends/corners to form a continuous expansion deck that completely surrounds the vessel.

In the illustrated embodiment, each expansion deck 10 can include, an elongated main deck body 11 having a top surface 11*a*, and a bottom surface 11*b*. In the preferred embodiment, each deck body 11 can include any number of different segments having individual lengths of 4 ft, 6 ft or 8 ft that are joined together serially to match the length of the vessel 1 onto which the system is being installed. Of course, other embodiments are contemplated wherein a single main deck body 11 is constructed to include a different lengths and/or width, so as to be sized specifically for a particular make or model vessel.

In the preferred embodiment, the deck body can be constructed from elongated sheets of nonslip acrylic, for example, which is known to have excellent durability and water-resistant properties. Of course, the deck body may also be constructed from any number of other materials suitable for prolonged exposure to water and that are relatively strong and stiff for their weight. Several nonlimiting examples include, but are not limited to various types of wood, plastics/polymers and/or various composite materials, for example.

In the preferred embodiment, the expansion deck system 10 can include a plurality of hinges 12 that pivotally secure the deck body 11 onto the boat 1. The hinges 12 can be secured onto any suitable portion of the boat 1 but will preferably be secured onto the floor 3 utilizing hardware (e.g., screws nuts and bolts) that penetrates the floor and anchors into the floor support beams (not illustrated). In either instance, any number and/or type of hinges 12 can be utilized so as to allow the deck to transition (see arrow a) between the extended position of FIG. 1 and the folded position shown in FIG. 2A.

Figure 2A:
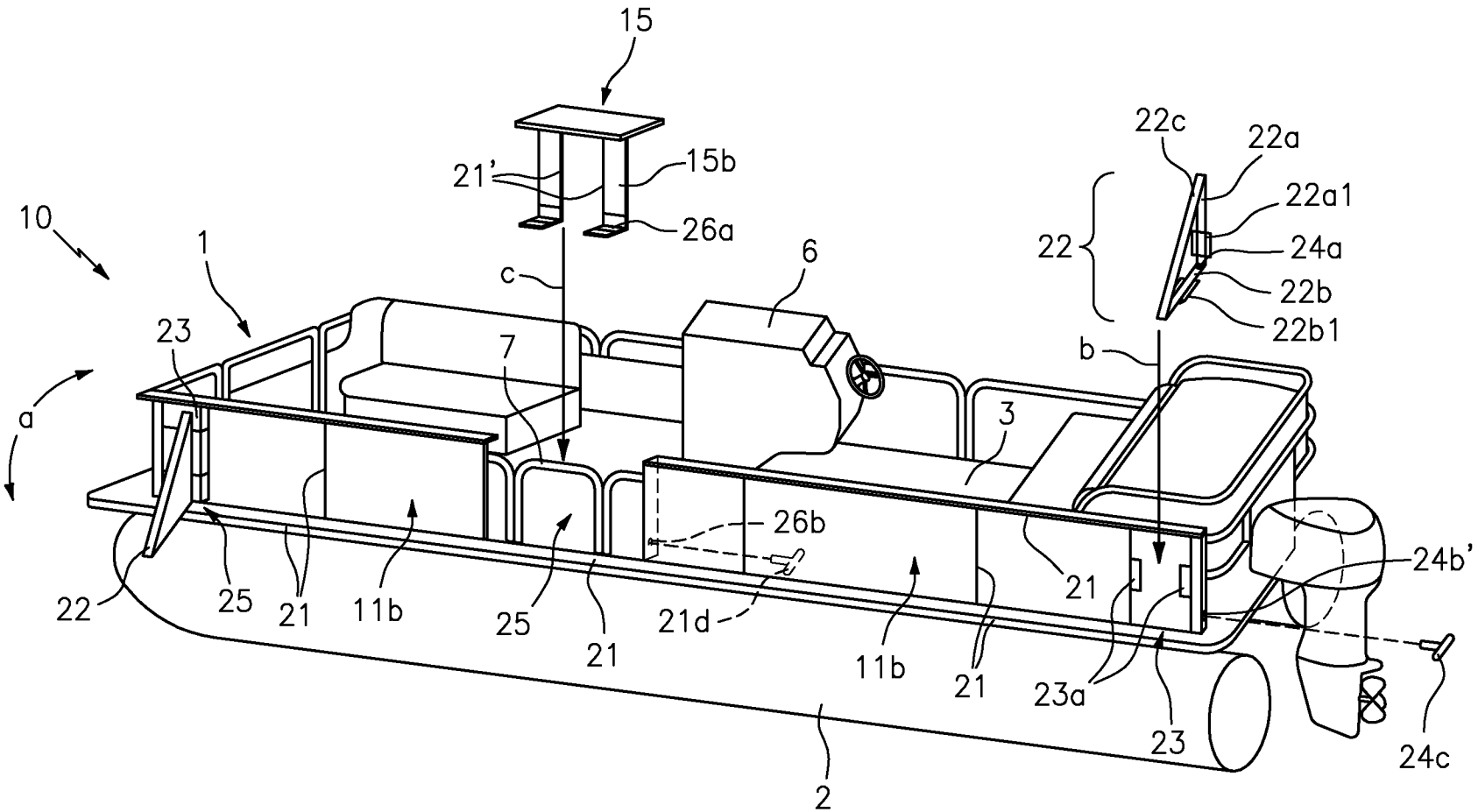
FIG. 2A is a perspective view of the expansion deck system in the folded position, in accordance with one embodiment of the invention.
Figure 2B:
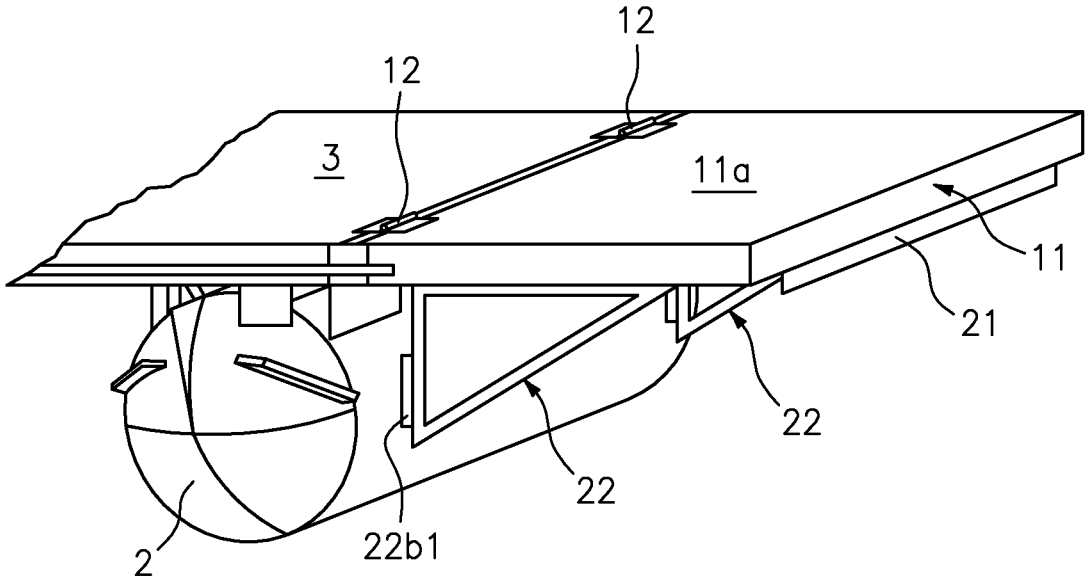
FIG. 2B is a partial cutout view of the expansion deck system in the folded position, in accordance with one embodiment of the invention.

As shown best at FIG. 2A, the deck 11 can be supported by a frame assembly that can include any number of individual frame elements 21 that are disposed in any orientation along the bottom surface 11*b* of the deck. In the preferred embodiment, each of the frame elements 21 can be constructed from aluminum beams that are permanently joined together via brackets, welding or the like. The frame assembly functioning to provide structural support to the deck body to prevent warping, sagging or other manipulations of the planar deck body surface.

In one embodiment, the system 10 can include a plurality of generally triangular-shaped braces 22, which can function to support the weight of the deck body 11 in the extended position and to maintain the extended deck body at a level/coplanar orientation to the vessel floor 3. To this end, each of the braces can include a first section 22*a* having protrusions 22*a*1 along either side, a second section 22*b* for engaging one of the pontoons 2, and a third section 22*c* that is positioned diagonally between the first and second sections.

In one embodiment an impact absorbing material 22*b*1 such as wood, carpet, padding or foam, for example, can be provided along the second section 22*b*. The material can function to provide a cushioning layer between the brace 22 and pontoon 2 so as to prevent or otherwise limit damage caused to the pontoon from forces applied by the brace. In one embodiment the impact absorbing material can be removably secured along an entirety or a portion of the second section, so as to be replaceable over time.

A plurality of brace receivers 23 can be located along the bottom surface of the main body 11*b*. In one embodiment, each of the receivers can comprise two substantially parallel members each having an inward radiating ledge 23*a* behind which the protrusions of a single brace 22 can be positioned. As shown by arrow b, when the deck is in the folded position, each of the braces 22 can be aligned with the outer end of a receiver 23 and slid downward until corresponding apertures 24*a* and 24*b* are aligned. At this time, the brace can be secured to the main body via hardware such as a locking pin 24*c*, for example.

By providing removable braces that can be installed just prior to launching the vessel, the system advantageously provides a continuous rigid braced support that extends the entire distance between the inside edge of the deck body to outside edge of the deck body when the system is in the extended position.

Moreover, when the deck body 11 is transitioned to the folded position and the braces 22 are removed, the expansion deck does not extend laterally away from the vessel and therefore does not increase the overall width of the vessel or violate applicable DOT regulations for vehicular towing. Although not specifically illustrated, the system 10 can include connectors or other such hardware for securing the deck body in the folded position during transport.

In one embodiment, the deck body 11 can include a removable section 15 that is positioned at a generally parallel orientation to the vessel door 7, so as to allow for ingress and egress of the vessel 1 when the deck is in the folded position. In this regard, the removable section 15 can include a top surface 15*a* and a bottom surface 15*b*. Additional framing 21' can be provided along the bottom surface of the removable section and can include an outer ledge that can engage a door receiver 25.

The door receiver 25 can be positioned along the bottom surface of the main deck body 11*b* and can also include two substantially parallel channels each having an inward radiating ledge 25*a* behind which the outer edges of the door framing 21' can be positioned. As shown by arrow C, the door 15 can be aligned with the outer end of a receiver 23 and slid therein until corresponding apertures 26*a* and 26*b* are aligned. At this time, the door can be secured to the main body via another locking pin 26*c* or other such hardware, for example.

Although described above as including bracing and receivers having a particular shape, size or mating characteristics, this is for illustrative purposes only. To this end, any number of other types of components capable of performing the above noted bracing, regardless of shape, size or location are also contemplated. Likewise, any device or structure capable of removably receiving and securing the braces and/or door 15 are also contemplated. Further, although illustrated as including two braces, the system 10 can include any number of braces that can be removably positioned along the deck body at any location.

Figure 3:
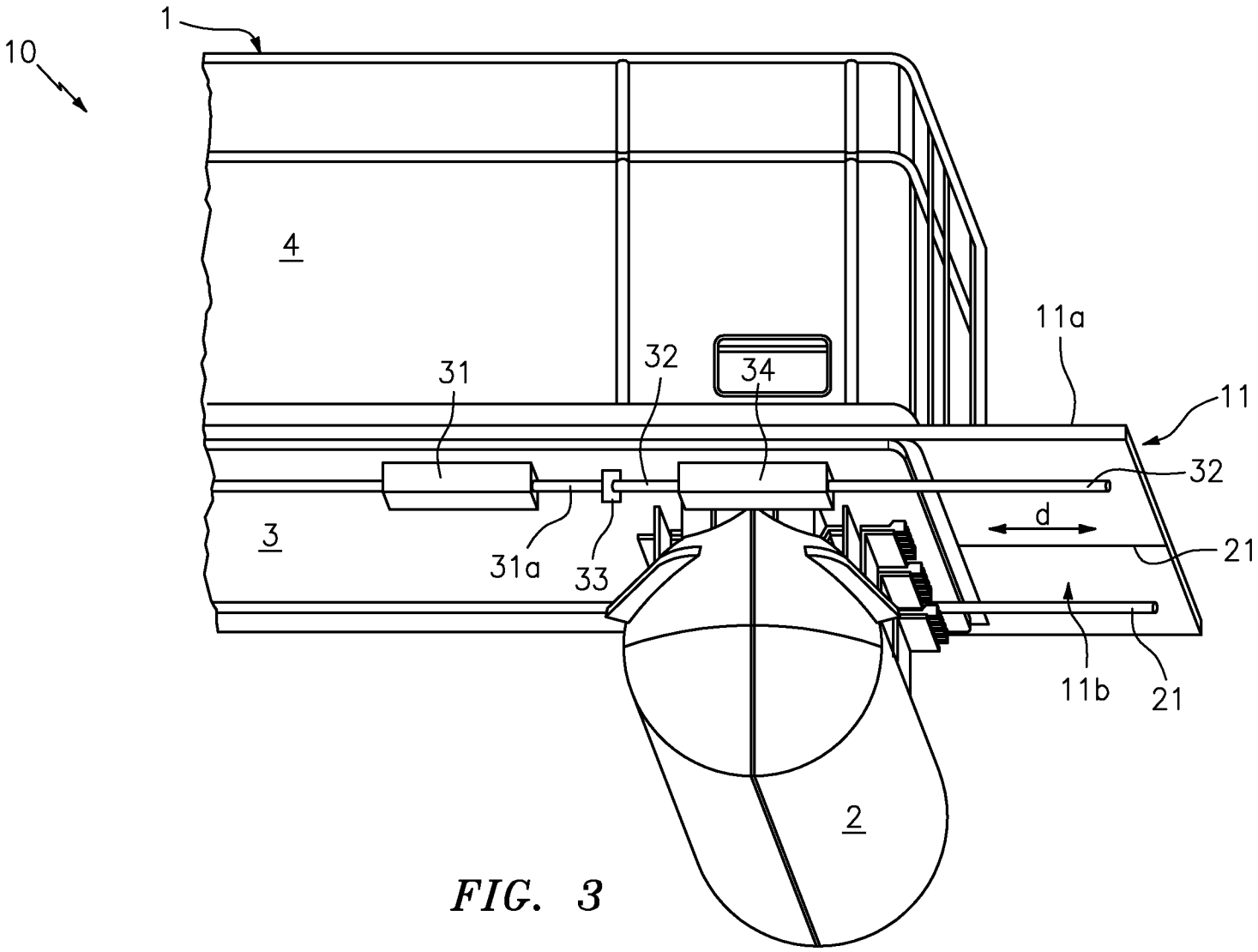
FIG. 3 is a bottom perspective view of the expansion deck system in the folded position, in accordance with one embodiment of the invention.

As shown at FIG. 3, one embodiment of the expansion deck system 10 can include one or more electromechanical bracing units that can augment or replace the above noted triangular-shaped braces 22. The electromechanical bracing unit can include a linear actuator 31, an elongated brace 32 and a guide sleeve 34.

In one embodiment, the linear actuator can include, comprise or consist of a hydraulic cylinder 31 having a rod 31*a* that extends and retracts from one end. The cylinder can be secured beneath the floor 3 of the vessel 1 so as to be perpendicular to the major axis of the deck body 11. In various embodiments the cylinder can comprise a self-contained pump and reservoir; however other embodiments are contemplated where the cylinder is connected to a remotely located pump and reservoir via hydraulic lines.

Of course, the inventive concepts are not limited to the use of a hydraulic system, as any number of other systems capable of moving in a linear manner are also contemplated. Several nonlimiting examples include pneumatic actuators, twisted and coiled polymer actuators, and piezoelectric actuators, for example.

In one embodiment, the brace 32 can include an elongated rigid planar member such as a solid aluminum square tubing or steel, for example. One end of the brace can be secured to the distal end of the cylinder rod 31*a* via a connector 33 such as a clamp, weld or bolt, for example, and the other end of the brace can extend outward toward the deck body 11.

The guide sleeve 34 can include an elongated hollow channel having an inside dimension that is complementary to the outside dimension of the planar brace 32. In the preferred embodiment, the guide sleeve can comprise a hollow piece of aluminum square tubing that is positioned between the linear actuator 31 and the deck body 11; however, other materials, shapes and locations are also contemplated.

As shown, components can be arranged along the vessel 1 so as to position the brace 32 between the top of the pontoon 2 and the bottom of the vessel floor 3. As shown by arrow d, the actuator 31 can selectively push and pull the brace through the guide sleeve. As such, when the actuator 31 in the fully extended position, the top surface of the brace can be in contact with the bottom surface of the deck body 11*b*, and the distal end of the brace can be positioned against or adjacent to the outermost piece of longitudinal deck bracing 22.

Conversely, when the actuator is in the fully retracted position, the top surface of the brace will not be in contact with the bottom surface of the deck body 11*b*, and the distal end of the brace will be positioned beneath the floor 3 of the vessel so as to not affect operation of the deck body or affect the overall width of the vessel. In various embodiments, additional guide sleeves or receiver channels can be positioned along the bottom surface of the deck body so as to receive and secure the distal end of the brace member 32. Such a feature preventing any type of vertical movement of the deck when in the extended position.

Figure 4A:
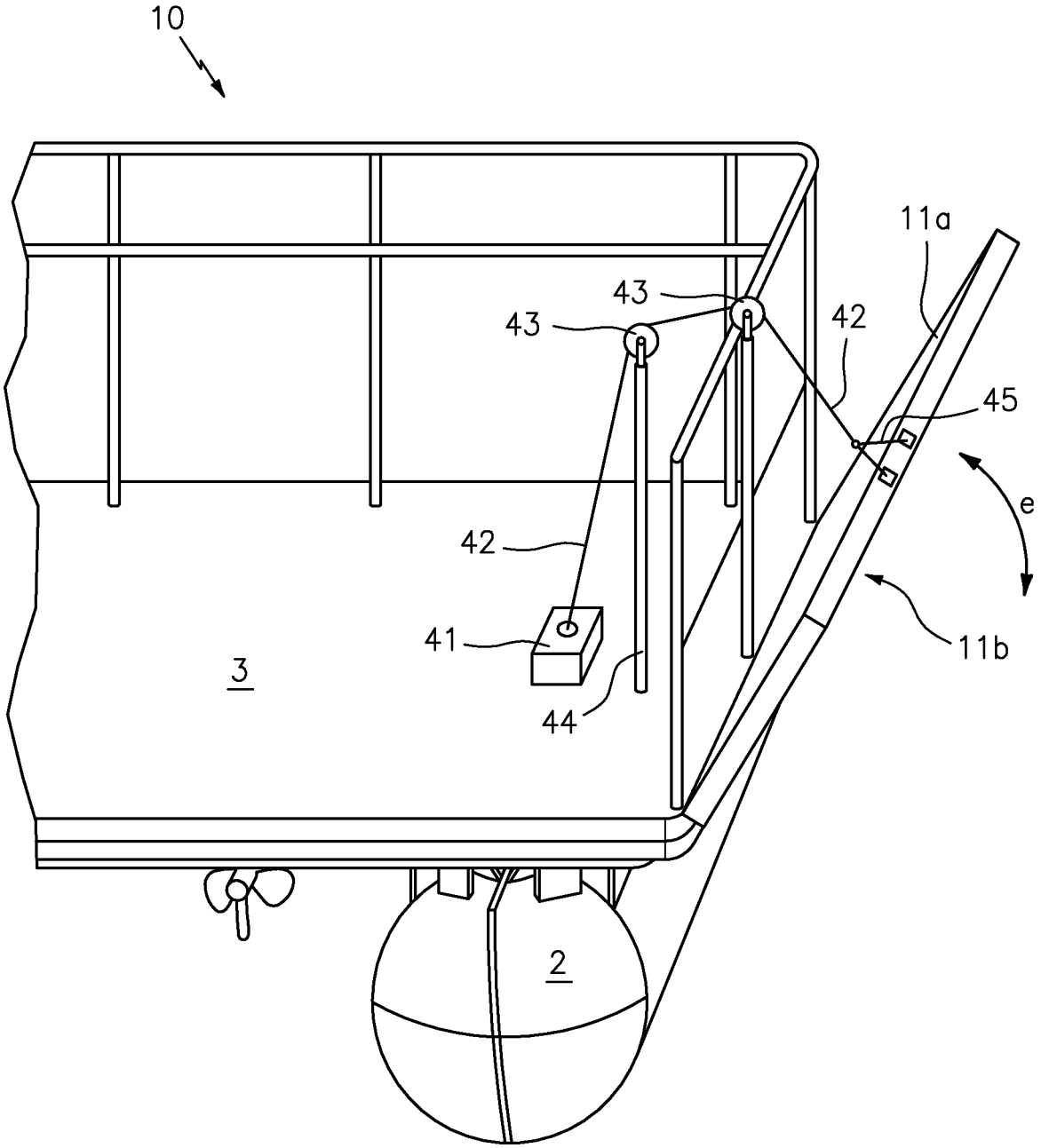
FIG. 4A is a perspective view of the expansion deck system in operation, in accordance with one embodiment of the invention.
Figure 4B:
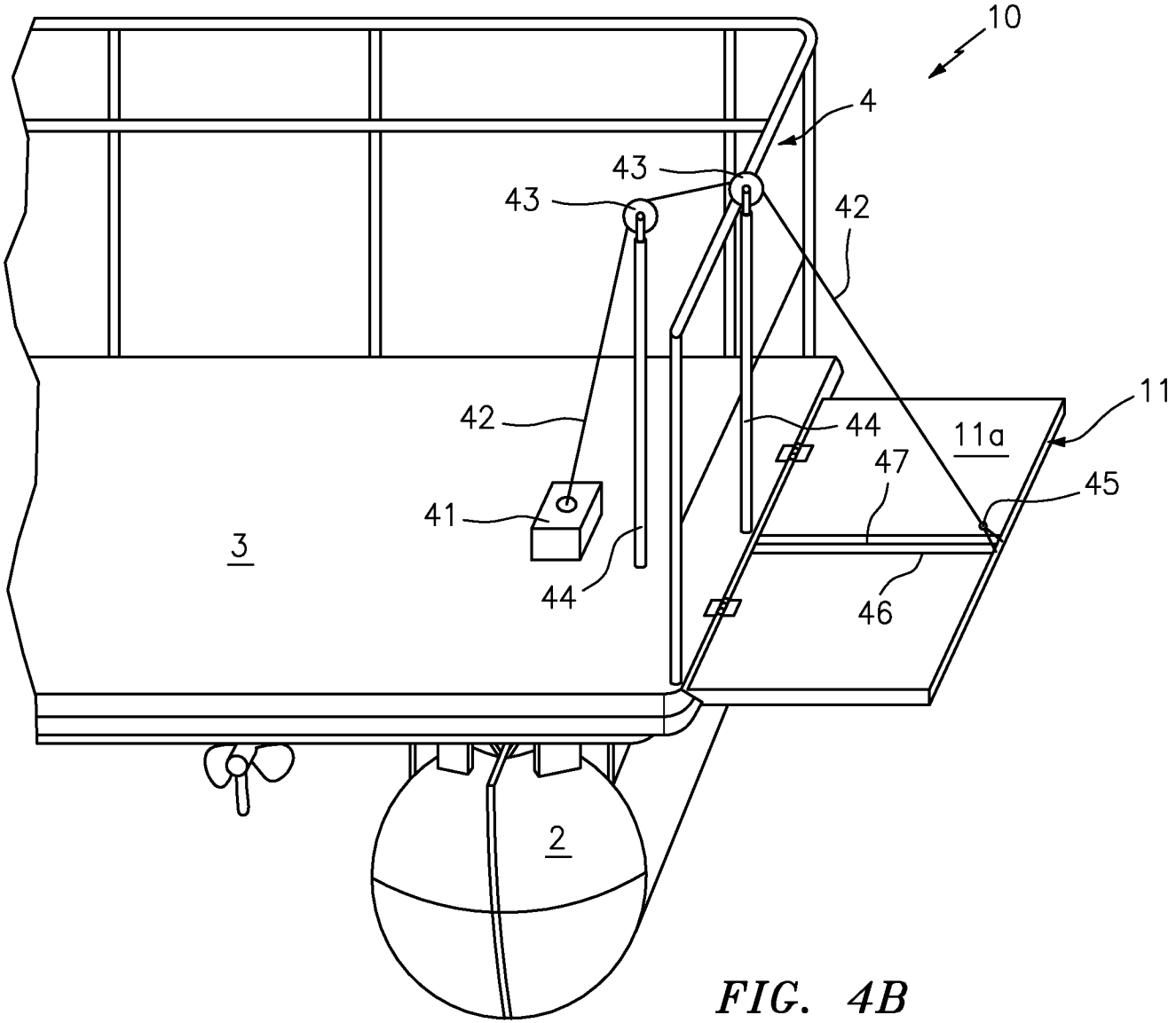
FIG. 4B is another perspective view of the expansion deck system in operation, in accordance with one embodiment of the invention.
Figure 4C:
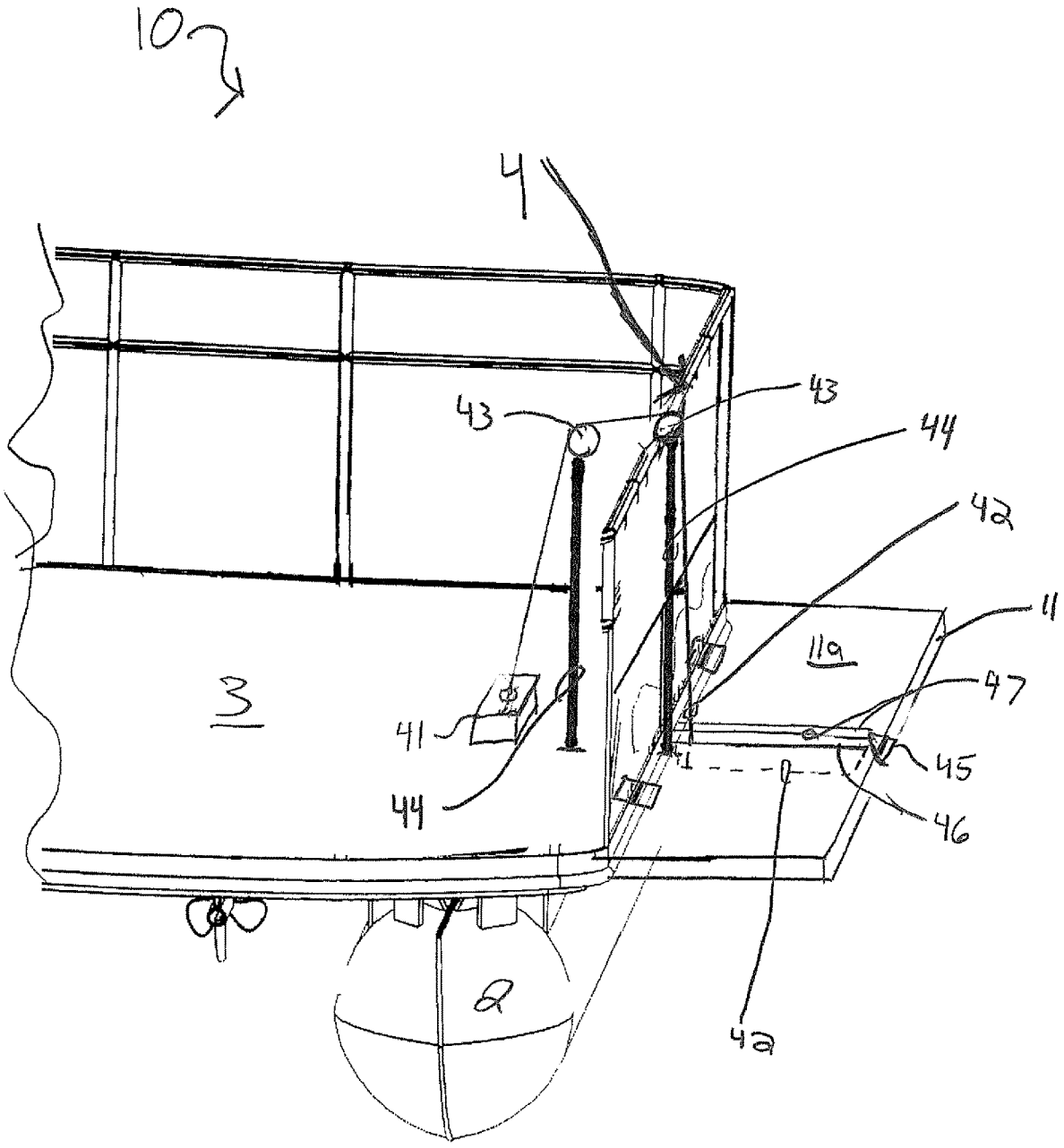
FIG. 4C is another perspective view of the expansion deck system in operation, in accordance with one embodiment of the invention.

As shown in FIGS. 4A-4C, one embodiment of the expansion deck system 10 can include a power lift unit for transitioning the deck body 11 between the extended and folded positions. As shown, the unit can include a power winch 41 that is secured to the floor 3 of the vessel. The winch can be in electrical communication with the boat controls (not illustrated) or can include a switch for direct operation by a user.

The winch can include an elongated tether 42 that is routed through two pulleys/cable guides 43 that are positioned on either side of the safety railing 4 by rigid poles 44, for example. In this regard, the poles 44 can be permanently or removably secured to the boat floor 3. As shown, the cable guides are positioned above the top surface of the safety railings so as to ensure the downward force imparted by the tether during operation does not affect or otherwise make contact with the safety railing. The distal end of the tether 42 can be connected to the outside edge of the deck body 11 via hardware 45 such as a clamp, clasp or the like.

In the preferred embodiment, a channel 46 can be provided along the top surface 11*a* of the deck body 11. The channel can include a resilient cover 47 having a slit for allowing access to the channel. The channel can be positioned perpendicular to the major axis of the deck body and parallel with the orientation of the tether 42.

As shown at FIG. 4C, when the deck body is in the fully extended position, the winch 41 can continue to operate until there is enough slack for a user to push the tether 42 through the slit of the flap 47 so as to position the tether within the channel 46. Such a feature advantageously allows a user full access to the entire top surface of the deck body 11*a* and ensures there are no obstructions which can pose a tripping hazard during use.

Although described above for use with an existing vessel, the inventive concepts are not limited to this use, as it is also contemplated that the expansion deck(s) can be provided with the new construction of a vessel 1, so as to be available as a factory option.

Accordingly, the above described expansion deck system provides a novel solution that greatly increases the useable deck space of a vessel while eliminating tripping hazards so as to allow users full access to the entire expansion deck area.

As described herein, one or more elements of the expansion deck system 10 can be secured together utilizing any number of known attachment means such as, for example, screws, glue, compression fittings and welds, among others. Moreover, although the above embodiments have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Likewise, the terms "consisting" shall be used to describe only those components identified. In each instance where a device comprises certain elements, it will inherently consist of each of those identified elements as well.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

The invention claimed is:

1. An expansion deck system for a vessel, said system comprising:

an elongated deck body having a top surface, a bottom surface, an inside edge and an outside edge;

a plurality of hinges that are positioned along the top surface of the deck body adjacent to the inside edge, said hinges being configured to pivotally secure the deck body to a floor of the vessel;

a plurality of brace receivers that are positioned along the bottom surface of the elongated deck body, said brace receivers being oriented perpendicular to a major axis of the deck body;

a plurality of braces each having a first section that is removably secured to one of the plurality of brace receivers; and a support frame assembly that is positioned along the bottom surface of the deck body, wherein the deck body is configured to transition between a folded position and an extended position, and wherein each of the plurality of braces includes a second section that is configured to engage a pontoon of the vessel when the deck body is in the extended position.

2. The system of claim 1, further comprising:

an impact absorbing material that is positioned along the second section of each of the plurality of braces.

3. The system of claim 1, wherein the deck body further includes a removable section.

4. The system of claim 3, wherein the removable section is positioned along the deck body so as to be parallel to a door of the vessel.

5. The system of claim 1, further comprising:

an electromechanical bracing unit that is configured to be secured between the floor of the vessel and a pontoon of the vessel.

6. The system of claim 5, wherein the electromechanical bracing unit is positioned perpendicular to a major axis of the deck body.

7. The system of claim 5, wherein the electromechanical bracing unit comprises:

a linear actuator;

a guide sleeve; and an elongated rigid member, wherein the linear actuator is configured to move the rigid member between a retracted position and an extended position.

8. The system of claim 7, wherein in the retracted position a distal end of the rigid member is positioned between the floor of the vessel and the pontoon of the vessel.

9. The system of claim 7, wherein in the extended position a top surface of the rigid member is in contact with the bottom surface of the deck body, and the distal end of the rigid member is in communication with the outside edge of the deck body.

10. A vessel, comprising:

a plurality of pontoon floats having a floor, a railing, and a control console;

at least one expansion deck system, that includes an elongated deck body having a top surface, a bottom surface, an inside edge and an outside edge;

a plurality of hinges that are positioned along the top surface of the deck body adjacent to the inside edge, said hinges being configured to pivotally secure the deck body to the floor of the vessel;

an electromechanical bracing unit that is configured to be secured between the floor of the vessel and at least one of the plurality of pontoon floats; and a support frame assembly that is positioned along the bottom surface of the deck body, wherein the deck body is configured to transition between a folded position and an extended position.

11. An expansion deck system for a vessel, said system comprising:

an elongated deck body having a top surface, a bottom surface, an inside edge and an outside edge;

a plurality of hinges that are positioned along the top surface of the deck body adjacent to the inside edge, said hinges being configured to pivotally secure the deck body to a floor of the vessel;

an electromechanical bracing unit that is configured to be secured between the floor of the vessel and a pontoon of the vessel; and a support frame assembly that is positioned along the bottom surface of the deck body, wherein the deck body is configured to transition between a folded position and an extended position.

* * * * *